United States Patent [19]

Shumaker

[11] 4,329,797

[45] May 18, 1982

[54] AMPLIFIED LOADER ARM

[75] Inventor: John F. Shumaker, Mt. Pleasant, Iowa

[73] Assignee: J. I. Case Company, Racine, Wis.

[21] Appl. No.: 228,325

[22] Filed: Jan. 26, 1981

[51] Int. Cl.[3] ..... E02F 3/00

[52] U.S. Cl. ..... 37/118 R; 414/685; 414/722

[58] Field of Search ..... 37/118, 117.5, 103; 414/685, 686, 697-701, 710, 711, 722, 728, 694

[56] References Cited

U.S. PATENT DOCUMENTS

| | | | |
|---|---|---|---|
| 2,468,424 | 4/1949 | Brauch | 414/722 |
| 2,526,500 | 10/1950 | Pilch | 414/697 |
| 2,986,293 | 5/1961 | Konefes | 414/697 |
| 3,568,869 | 3/1971 | Beiley | 414/701 |

FOREIGN PATENT DOCUMENTS

| | | | |
|---|---|---|---|
| 1924269 | 11/1970 | Fed. Rep. of Germany | 414/686 |
| 2011302 | 12/1970 | Fed. Rep. of Germany | 414/686 |
| 2010943 | 9/1971 | Fed. Rep. of Germany | 414/699 |
| 2351426 | 4/1974 | Fed. Rep. of Germany | 414/697 |
| 2338426 | 2/1975 | Fed. Rep. of Germany | 414/685 |
| 197627 | 8/1965 | Sweden | 414/685 |

*Primary Examiner*—E. H. Eickholt

*Attorney, Agent, or Firm*—Dressler, Goldsmith, Shore, Sutker & Milnamow, Ltd.

[57] ABSTRACT

A linkage system is described for increasing the moment arm of the hydraulic actuator or motor used to raise the lift arm of a material handling machine as the lift arm is rotated between its lowered and its raised position. The linkage includes a generally vertically disposed connecting link and a generally V-shaped lever arm. The connecting link translates the rotation of the lift arm into a vertical displacement. The lever arm converts the vertical displacement of the connecting link to rotate the lower end of the lift arm actuator forwardly and downwardly so that its position relative to the pivot point of the left arm increases as the lift arm is rotated to its raised position. Thus, a generally greater moment arm is produced to raise the lift arm in contradistinction to the lifting linkages of the prior art where the lifting moment arm generally decreased as the lift arm was rotated upwardly.

6 Claims, 7 Drawing Figures

AMPLIFIED LOADER ARM

TECHNICAL FIELD

This invention relates to material handling equipment, and more particularly, to machines, such as loaders, having an implement such as a bucket or scoop pivoted at the end of an arm.

BACKGROUND OF THE INVENTION

The most advanced development of the classic bulldozer is the front-end tractor shovel. This machine is also called a shovel dozer, a dozer shovel, a tractor loader, an end loader, a front loader, or just a loader. It is used for loading, roughgrading and limited hauling. A typical front-end loader includes: a support frame often mounted on the body of a tractor; a hydraulic system; a pair of push or lift arms, sometimes called a boom, hinged to the support frame; a tractor width bucket hinged to the front end of the lift arms; and a pair of dump arms hinged to both the lift arms and to the bucket.

The normal operation of front-end loader involves positioning the bucket in a "dig" or working position and then forcing the bucket into a pile of material by driving the tractor forward in low gear. When the resistance slows the tractor, the bucket is pivoted or "rolled back" on the lift arm while the lift arm is raised to force or break out the mass of material within the bucket from the remainder of the pile. Rolling back the bucket as it rises in the bank increases the cutting efficiency by aligning the leading edge with its upward movement. By retracting the bucket for a thinner slice, the bucket's own suction and crowding by the tractor tend to make the cut thicker. The proper balance among these forces varies with the loader being used, the slope of the soil bank, and the position and momentum of the bucket. The loader operator balances these various factors to efficiently operate the bucket and the loader to its optimum efficiency. Subsequently, the lift arms are elevated a sufficient distance to raise the bucket above the ground and then the tractor or machine is driven to some other location. Upon reaching the subsequent location, the bucket is pivoted to a "dumping position" where the contents are discharged after which the operation is repeated.

From the foregoing it should be appreciated that when the bucket is driven into the soil, the lift arms of the loader are fully extended to obtain the maximum thrust from the tractor. The greatest downward force is imposed at the bucket end of the loader arms when the bucket is pivoted during filling. Thus, a very large moment arm is imposed upon the tractor which must be overcome by the hydraulic actuators used to raise the lift arms.

The prior art is replete with loader designs incorporating lift arms operated by a hydraulic piston and cylinder with one end of the hydraulic actuator connected to the loader arm, at a point intermediate the ends of the loader arm, and connected at its other end to a fixed pivot point on the body of the tractor. Since the two pivoted ends of the hydraulic actuator are fixed relative to the tractor and the loader arm, the lifting moment produced by the hydraulic actuator generally varies with the angle of the loader arm relative to the horizon (i.e. angle of lift). Consequently, the hydraulic actuator is normally positioned relative to the fixed pivot point of the lift arm on the tractor such that the greatest lifting moment is produced when the lift arms in their lowered position. Thus, as the lift arms are raised to their highest position, the moment arm used to raise the lift arm decreases. One effect of this mounting arrangement is that the time it takes to raise the lift arms increases as the angle of lift increases.

What is needed is a lifting mechanism wherein the moment used to raise the lift arm is kept as high as possible throughout the lift cycle. Such a mechanism would improve the overall productivity of the loader and make the best use of the tractor's hydraulic system.

SUMMARY OF THE INVENTION

In accordance with the present invention a linkage is provided suitable for use in raising the lift arms of a loader in such a manner that the raising moment provided by a hydraulic actuator does not decrease as the lift arms are moved from their lowered to their raised position. Specifically, the linkage includes a downwardly disposed first link which is pivoted at its upper end to the lower end of the lift arm; a generally V-shaped lever arm which is pivoted to the frame of the tractor or loader at a position intermediate its ends and pivoted at one end to the lower end of a downwardly disposed link; and a hydraulic motor or actuator pivotally connected at its lower end to the lever arm and pivotally connected at its upper end to the lift arm. Effectively, the V-shaped lever arm converts the upward motion of the lift arms to a forward displacement of the lower end hydraulic motor. Thus, as the lift arms are raised by the hydraulic actuator, the connecting link is displaced vertically upward while that end of the lever arm connected to the hydraulic actuator is displaced horizontally. This unique arrangement insures that the lower end of the hydraulic motor is moved further away from the pivotal connection of the lift arm to the tractor as the upper end of the lift arm is raised. This particular linkage arrangement improves the productivity of the loader to which it is attached by insuring that after the bucket breaks out a load of material, the lift arms can be raised to their highest position without the hydraulic system becoming overloaded or the fluid connections being overpressurized. Other advantages and features of the invention will become apparent from the following description, the claims, and the drawings which show an illustrative embodiment of the present invention.

DETAILED DESCRIPTION

Figure 1:
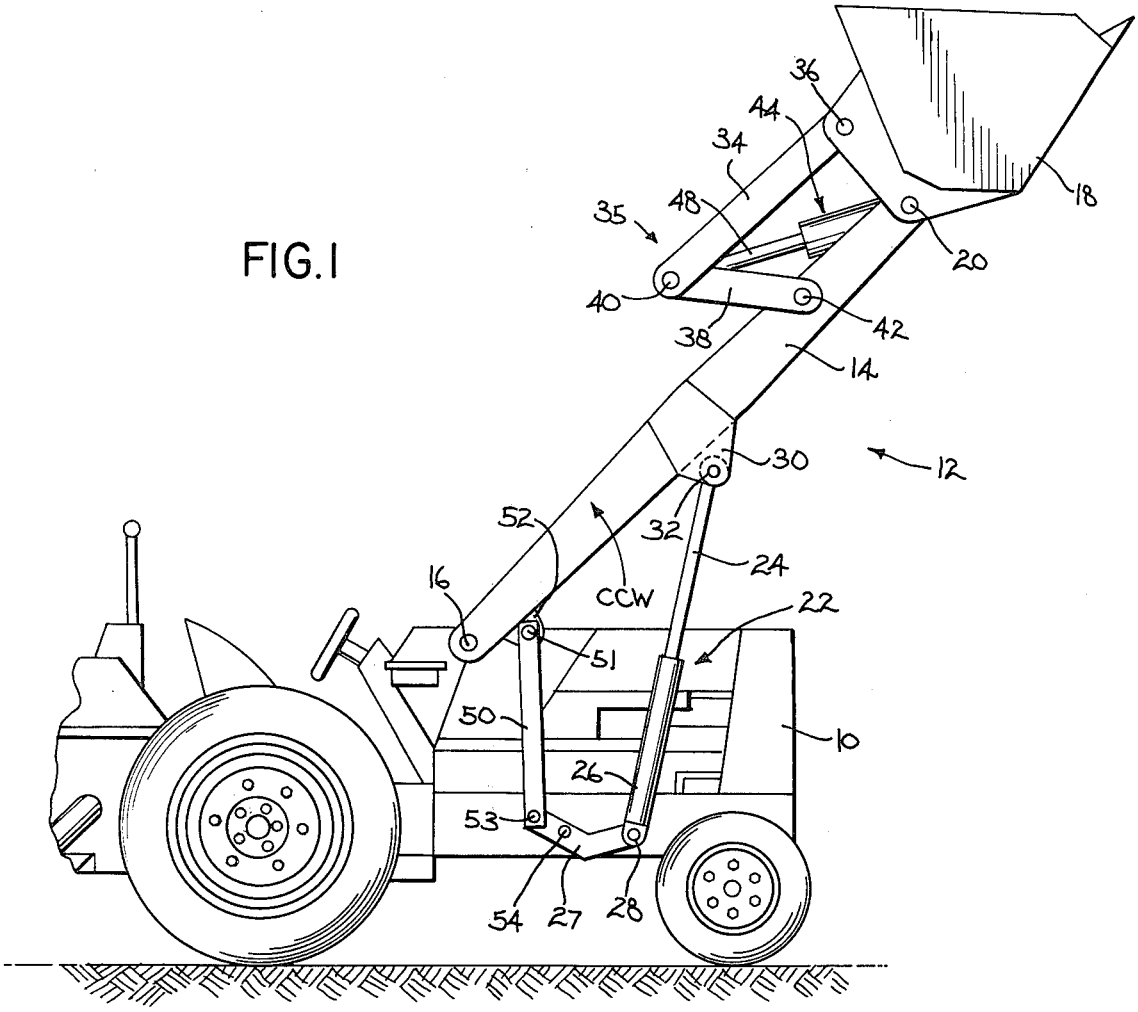
FIG. 1 is a side elevational view of a tractor having a front end loader whose lift arms are in the raised position, and the linkage that is the subject of the present invention.

While this invention is susceptible of embodiment in many different forms, there will be shown in the drawings and will herein be described in detail one specific embodiment with the understanding that the present disclosure is to be considered as an exemplification of the principles of the invention and is not intended to limit the invention to the specific embodiments illustrated.

Referring to the drawings, FIG. 1 is an elevational view of the right side of a tractor 10 on which has been mounted on the front end thereof a loader mechanism 12. The tractor 10 provides a support frame and a source of hydraulic power to operate the loader mechanism. The components of the loader mechanism 12 are, for the most part, duplicated on either side of the tractor 10; for this reason, only those components on the right side of the tractor will be described in detail with the understanding that the description will likewise refer to an identical set of components located on the left side of the tractor.

As illustrated in FIG. 1, the loader mechanism 12 includes a lift arm 14 pivotally connected at its lower end to the tractor frame by a pivot pin 16 and pivotally connected at its upper end to a bucket 18 by a pivot pin 20. The lift arm 14 is raised and lowered about the pivot pin 16 on the tractor 10 by the operation of a hydraulic actuator 22 (hereinafter alternatively referred to as the lift arm actuator or lift cylinder) through the extension or retraction of a piston rod 24 extending outwardly from a hydraulic cylinder 26. As shown in the drawings, the cylinder portion of the hydraulic actuator 22 is pivoted at its lower end to a generally V-shaped arm 27 by a pivot pin 28. The piston rod 24 of the hydraulic actuator 22 is disposed between and pivotally connected to a pair of downwardly extending reinforcing plates 30 by a pivot pin 32. These plates 30 are secured to an intermediate portion of the lift arm 14.

Thus, it can be seen without further description of the lever arm 27 that, when pressure is applied to the cylinder end of the hydraulic actuator 22, the lift arm 14 will be rotated in a counterclockwise direction (see arrow CCW) about the lift arm's pivotal connection 16 on the tractor 10 to raise the bucket 18. Conversely, when fluid is supplied to the piston rod side of the hydraulic actuator 22, the lift arm 14 will be rotated clockwise in such a manner as to lower the bucket 18. These principles are conventional.

The positioning of the bucket 18 relative to the upper ends of the lift arm 14 is accomplished by a hydraulically operated bucket positioning mechanism 35. This mechanism pivotally joins the bucket 18 with the lift arm 14. Depending on the size of the bucket 18 and the load, the bucket positioning mechanism 35 can consist of two otherwise identical mechanisms on either side of the frame of the tractor 10 or a single mechanism on one side of the tractor. As illustrated in the drawings, the bucket positioning mechanism 35 consists of two links: a first link 34 and a second link 38. The first link 34 joined at one end to the bucket by a pivot pin 36 and at the opposite end to a second link 38 by a pivot pin 40. The second link 38 is pivotally connected to the lift arm 14 by a pin 42. Thus, it can be seen that pivotal movement of the second link 38 about the pivot pin 42 joining it to the lift arm 14 will pivot the bucket 18 in the same direction about the upper end of the lift arm.

Figure 2:
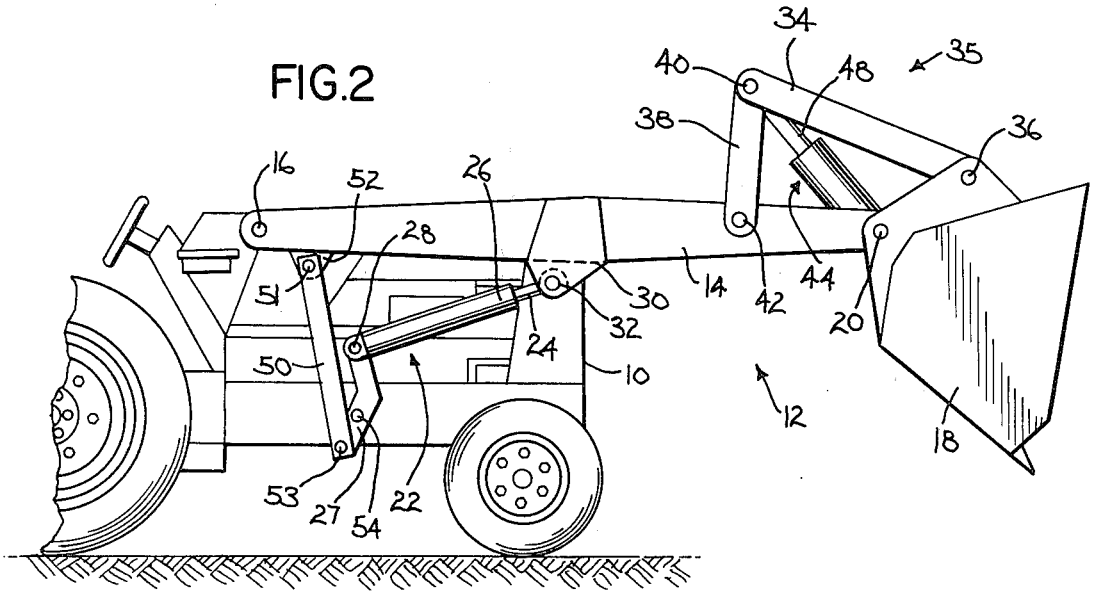
FIG. 2 is a partial, side elevational view of the tractor shown in FIG. 1 with the lift arms in the lowered position.

To rotate the first 34 and second 38 links a hydraulic actuator 44 (hereinafter, alternatively referred to as the bucket actuator) is used. As illustrated in the drawings, the bucket actuator 44 has its cylinder end pivotally connected to the lift arm 14 and its piston rod 48 pivotally connected to the pivot pin 40 joining the first and second links 34 and 38, respectively. When the piston rod 38 of the bucket actuator 44 is driven inwardly, the second link 38 rotates clockwise and the bucket 18 rotates in the same direction. In FIG. 1 the bucket 18 is shown in its "filled position," in FIG. 2 the bucket is shown in its "dumped position". Thus, the introduction of pressurized fluid to one end of the bucket actuator 44 and the corresponding withdrawal of fluid from the other end results in pivotal movement of the bucket 18 relative to the lift arm 14. It is, of course, understood that if two bucket actuators 44 are used, they are operated simultaneously to bring about the desired result. The particular details of the hydraulic system used to operate such a loader mechanism are well known to those skilled in the art. The loader described by Long in U.S. Pat. No. 3,220,580 (and assigned to the assignee of the present invention) is incorporated by reference insofar as it describes the details of a typical hydraulic system used to operate the loader mechanism 12.

Figure 4A:
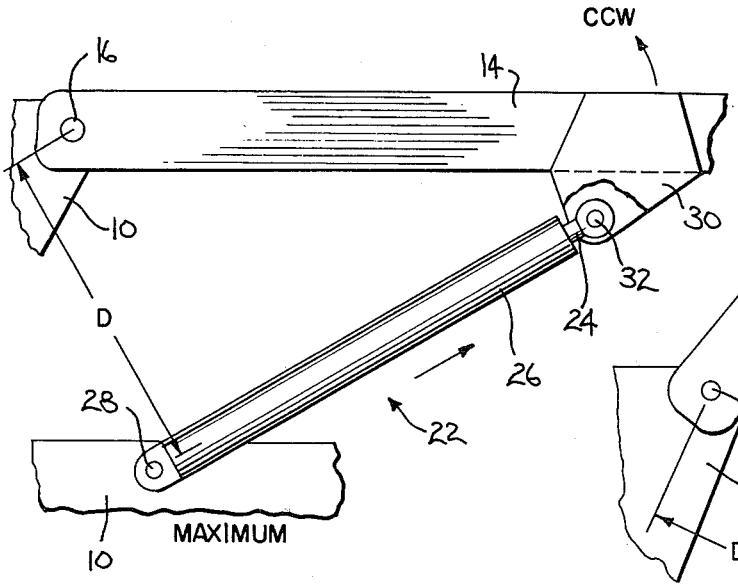
FIGS. 4A and 4B are enlarged partial side elevational views of the linkage ordinarily used to raise the lift arms of a front end loader.
Figure 4B:
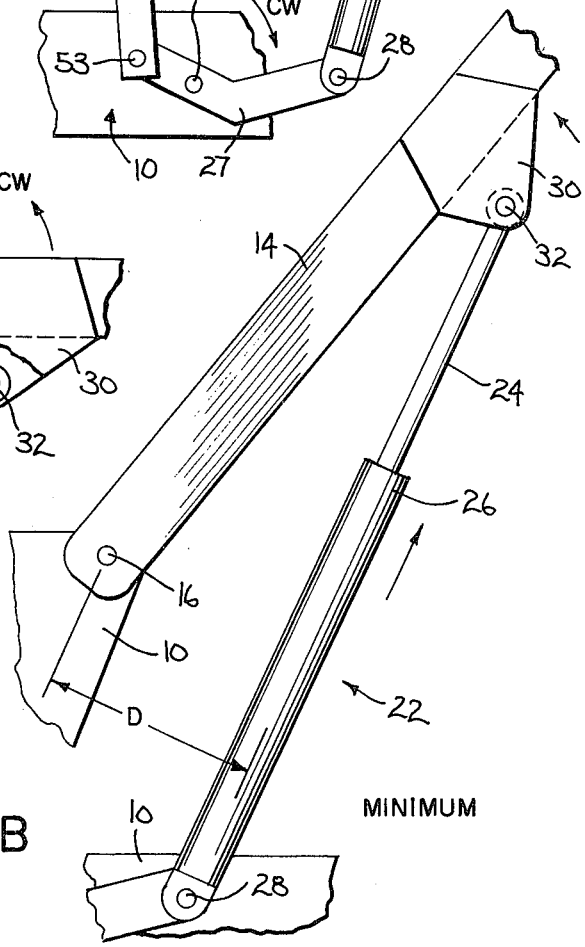

FIGS. 4A and 4B illustrate the conventional manner of mounting the lift arm actuator 22 in relationship to the lift arm 14. One of the reinforcing plates 30 has been broken away in FIG. 4A to illustrate the manner in which the piston rod 34 of the lift arm actuator 22 is pivotally connected. Specifically, the lower end of the lift arm 14 is pivoted to the tractor 10 by pivot pin 16. Similarly, the lower end of the lift arm actuator 22 is pivotally connected by a pin 28 to a fixed portion of the tractor frame 10. Thus, when the lift arm 14 is in its lowered position (see FIG. 4A) and the lift arm actuator 22 is in its retracted condition a "moment arm" is defined. The moment arm is the product of the force produced by the lift arm actuator 22 and the perpendicular distance from the pivot pin 16 to the longitudinal axis of the lift arm actuator 22. As the lift arm actuator 22 is extended the lift arm 14 is rotated counterclockwise CCW.

Since the pivot point of the lower end of the lift arm 14 and the point of the lower end of the lift arm actuator 22 are fixed in relationship to each other, extending the lift arm actuator 22 has the effect of decreasing the perpendicular distance D' between the pivot pin 16 at the lower end of the lift arm 14 and the longitudinal axis of the lift arm actuator. Thus, the moment arm produced by the lift arm actuator 22 in raising the lift arm decreases as the lift arm is increased to a greater and greater height. It should be appreciated that this is an unsatisfactory condition in that the tractor's hydraulic system becomes increasingly loaded as the lift arm is raised.

Figure 3A:
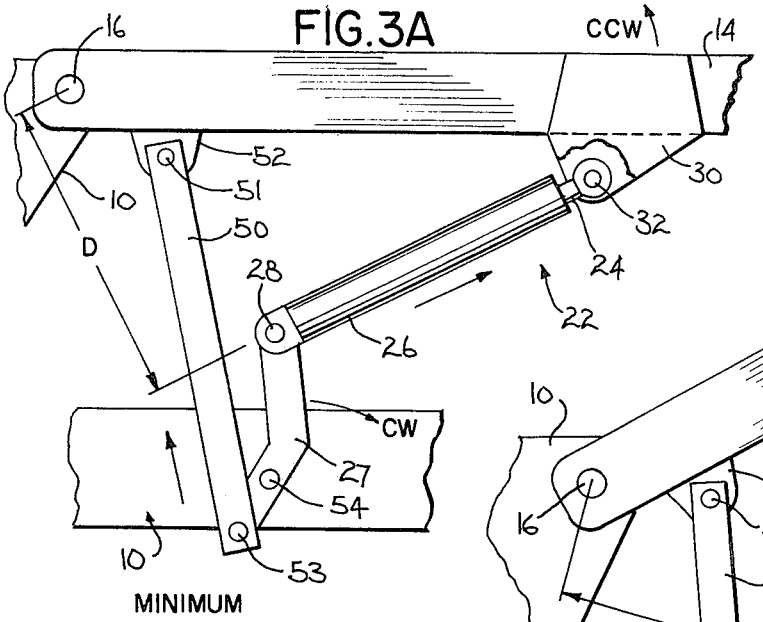
FIGS. 3A and 3B are enlarged partial side elevational views of the lift arm and linkage shown in FIGS. 1 and 2 illustrating the manner in which the various components move in raising the lift arms.
Figure 3B:
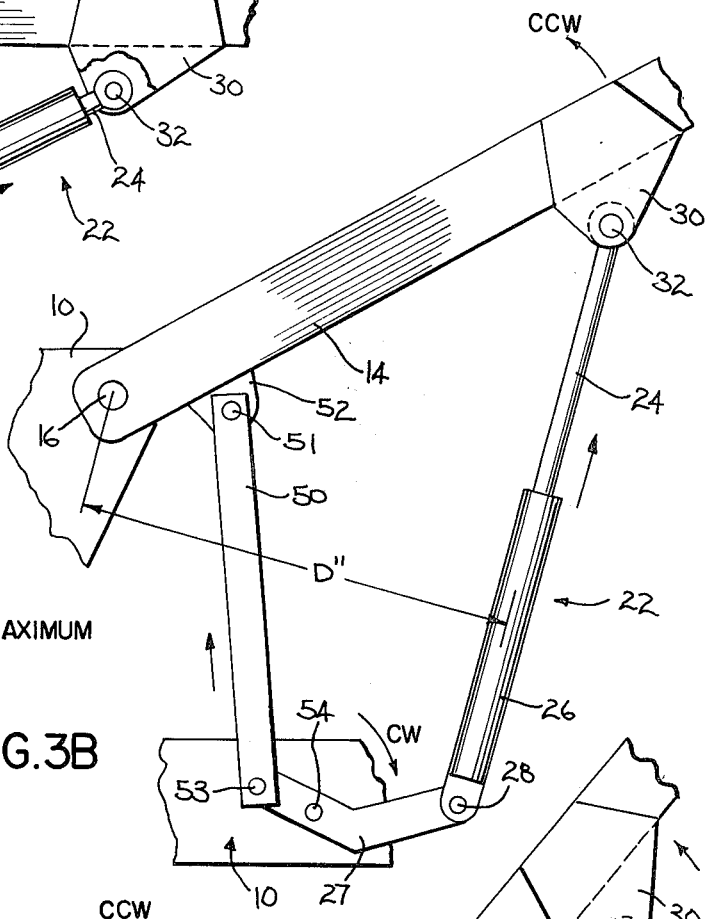
Figure 5:
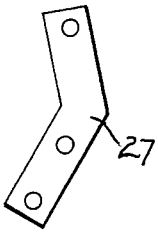

FIGS. 3A and 3B illustrate in greater detail the linkage that is the subject of the present invention. In addition to the lift arm 14 and the lift arm actuator 22 previously described, the linkage used to raise the lift arm includes a generally vertically disposed connecting link 50, and a forwardly disposed lever arm 27 which is pivoted intermediate its ends to the frame 10 of the tractor. The upper end of the connecting link 50 is pivotally connected by a pin 51 to a bracket 52 joined to the lift arm 14. This bracket 52 is positioned at a point intermediate the two ends of the lift arm and adjacent the lower end of the lift arm. The lower end of the connecting link 50 is pivotally connected by a pin 53 to one end of the lever arm 27.

The lever arm 27 illustrated in the drawings is generally V-shaped and is pivotally connected to the tractor 10 by a pivot pin 54 which is disposed at a point intermediate the ends of the lever arm and generally adjacent that end of the lever arm pivotally connected to the connecting link 50. The opposite end of the lever arm 27 is pivotally connected by a pin 28 to the lower end of the lift arm actuator 22. When so connected to the tractor and with the lift arm 14 in its lowered position, the linkage used for raising and lowering the lift arm is arranged as illustrated in FIG. 3A. This arrangement defines a moment arm which is equal to product of the force of the lift arm actuator 22 and the perpendicular distance D measured between the lift arm pivot pin 16 and the longitudinal axis of the lift arm actuator 22.

The operation of the linkage will now be discussed. Referring to FIG. 3A, it should be clear that as the lift arm actuator 22 is extended the lift arm 14 is rotated upwardly in the counterclockwise direction CCW. As the lift arm is rotated upwardly, the bracket 52 at the lower end of the lift arm is also raised upwardly. Thus, the connecting link 50 is also raised upwardly which, of course, raises that end of the lever arm 27 joined to the connecting link. This upward motion of the connecting link or generally vertical displacement of the connecting link pivots the lever arm about its pivotal connection 54 to the frame of the tractor 10 so as to rotate that end of the lever arm joined to the lift arm actuator 22 in the clockwise direction CW. Since this end of the lever arm is disposed generally vertically, the counterclockwise rotation of the lift arm 15 induced by the extension of the lift arm actuator 22 is converted to a generally forward and downward displacement of the lower end of the lift arm actuator. This, of course, increases the distance between the lower end of the lift arm which is pivotally connected by a pin 16 to a fixed point on the tractor 10 in the pivot pin 28 at the lower end of the lift arm actuator 22. The various components of the linkage then assume the configuration shown generally in FIG. 3B. What is of significance is that the distance D″, measured perpendicularly from the pivotal connection 16 at the lower end of the lift arm 14 and the longitudinal axis of the lift arm actuator, has increased. This is in marked contrast with the condition illustrated in FIG. 4B where the corresponding distance D′ decreased as the lift arm 14 is raised.

Effectively, the lever arm synchronizes the movement of the lower end of the lift arm actuator 22 with the raising of the lift arm 14 in such a manner as to continuously change the relative position of the lower end of the lift arm actuator 22 in relationship to the lower end of the lift arm 14. The particular shape of the lever arm 27 or the particular manner in which the two arms of the V-shaped lever arm 27 are disposed in relationship to each other, the particular point or position on the lever arm which is pivotally connected to the tractor 10, and the spacial relationship between the lever arm pivot pin 54 and the lift arm pivot pin 16, all determine the particular "amplification effect" produced by the lever arm in increasing the moment arm applied to the lift arm by the lift arm actuator 22 as the lift arm is raised. The manner in which these various factors are used is largely dependent upon the particular geometry of the lift arms and the machine upon which the lift arms are installed. These are matters which can be adjusted by those skilled in the art.

While the invention has been described in conjunction with a specific embodiment, it is evident that there are other alternatives, modifications, and variations that will be apparent to those skilled in the art, in light of the foregoing detailed description. For example, the linkage could also be used to raise and lower the bed of a dump truck or similar machine. Accordingly, it is intended to cover all such alternatives, modifications, and variations as set forth within the spirit and broad scope of the appended claims.

What is claimed is:

1. A linkage for operating an implement arm which is pivoted at its lower end to the frame of a material handling machine and which carries an implement at its upper end, comprising:

(a) a downwardly disposed first link pivotally connected at its upper end to said implement arm adjacent the lower end of said implement arm;

(b) extensible hydraulic motor means, pivotally connected at its upper end to said implement arm at a position intermediate the ends of said implement arm and linked at its lower end to said frame for raising and lowering said implement arm, said hydraulic motor means defining a moment arm which is measured from the pivotal connection of said implement arm on said frame perpendicularly to the longitudinal axis of said motor means; and (c) lever arm means, pivotally connected to said frame at a position intermediate its ends and pivotally connected at one of its ends to the lower end of said first link and at its other end to the lower end of said motor means, for rotating the lower end of said motor means away from the lower end of said implement arm as the implement arm is raised, the other end of said lever arm means being generally disposed towards said implement arm and parallel to said first link, actuating said motor means from its retracted condition has the effect of:

(1) raising the upper end of said implement arm, (2) raising the lower end of said first link, (3) raising said one end of said lever arm means, and (4) rotating the other end of the lever arm means forwardly which shifts the lower end of the motor means forwardly and at a greater distance from the pivotal connection of the implement arm to the frame, whereby the upward rotation of said implement arm to its raised position is synchronized with the forward movement of the lower end of said motor means, and the resulting moment arm when said implement arm is in its raised position is generally greater than or at least equal to the moment arm defined by the hydraulic motor means when said implement arm was in its lowered position.

2. A linkage for operating an implement arm between a first position and a second position, said implement arm being pivoted at one of its ends to the frame of a material handling machine and carrying an implement at its other end, comprising:

(a) a first link pivotally connected at one of its ends to said implement arm adjacent said one end of said implement arm and disposed transversely relative to the longitudinal axis of said implement arm when said implement arm is in its first position;

(b) extensible hydraulic motor means, pivotally connected at one of its ends to said implement arm and linked at its other end to said frame, for rotating said implement arm between its first and second positions; and (c) lever arm means, pivotally connected to said frame at a position intermediate its ends and pivotally connected at one of its ends to the other end of said first link and at its other end to the other end of said motor means, for rotating the other end of said motor means away from said one end of said implement arm as the implement arm is rotated from its first to its second position, whereby the moment arm defined by said hydraulic motor means when said implement arm is in its second position is generally greater than or at least equal to the moment arm defined by the hydraulic motor means when said implement arm was in its first position.

3. The linkage set forth in claim 2, wherein said lever arm means is a generally V-shaped link defining two legs of unequal length, one of which is disposed towards said implement arm when said implement arm is in its first position.

4. The linkage set forth in claim 3, wherein that leg of said V-shaped link pivotally connected to said one end of said hydraulic motor means is the longer of said two legs, and said link is pivoted at a point intermediate the ends of the shorter leg.

5. The linkage set forth in claim 2, wherein said hydraulic motor means includes a cylinder pivotally connected to said lever arm means, a piston slidably disposed within said cylinder, and a piston rod joined to the piston and pivotally connected to said implement arm.

6. A linkage for rotating an implement arm which is pivoted at its lower end to the frame of a material handling machine and which carries an implement at its upper end, comprising:

(a) a downwardly disposed first link pivotally connected at its upper end to said implement arm adjacent the lower end of said implement arm;

(b) an asymmetric V-shaped lever arm, pivotally connected to said frame at a position intermediate its ends and pivotally connected at one of its ends to the lower end of said first link, the other end of said lever arm being generally disposed towards the upper end of said implement arm;

(b) an asymmetric V-shaped lever arm, pivotally connected to said frame at a position intermediate its ends and pivotally connected at one of its ends to the lower end of said first link, the other end of said lever arm being generally disposed towards the upper end of said implement arm;

(c) extensible hydraulic motor means, pivotally connected at its lower end to the other end of said lever arm and at its upper end to said implement arm at a position intermediate the ends of said implement arm for raising and lowering the upper end of said implement arm, said hydraulic motor means defining a moment arm which is measured from the pivotal connection of said implement arm on said frame perpendicularly to the longitudinal axis of said hydraulic motor, actuating said hydraulic motor means having the effect of: extending the upper end of said implement arm to its raised position, raising the lower end of said first link, raising said one end of said lever arm, and lowering the other end of the lever arm, which moves the lower end of the hydraulic motor means generally forwardly and downwardly, whereby the rotation of said implement arm to its raised position and the counter-rotation of said lever arm results in a moment arm which is at least as great as the moment arm defined by said hydraulic motor means when said implement arm was in its lowered position.

* * * * *